US005158199A

United States Patent [19]

Pontius

[11] Patent Number: 5,158,199

[45] Date of Patent: Oct. 27, 1992

[54] TEMPORARY DIAPER STORAGE CONTAINER

[75] Inventor: Jeffrey S. Pontius, Amanda, Ohio

[73] Assignee: Columbus Industries, Inc., Ashville, Ohio

[21] Appl. No.: 705,657

[22] Filed: May 24, 1991

Related U.S. Application Data

[63] Continuation-in-part of Ser. No. 529,506, May 29, 1990, Pat. No. 5,022,553.

[51] Int. Cl.[5] ..... B65D 90/04

[52] U.S. Cl. ..... 220/410; 220/417; 220/462; 220/470; 119/168

[58] Field of Search ..... 220/457, 408, 410, 460, 220/463, 462, 417, 470, 403, 407; 119/1

[56] References Cited

U.S. PATENT DOCUMENTS 3,880,341 4/1975 Bamburg et al. ..... 206/457
4,528,222 7/1985 Rzepecki et al. ..... 206/524.3
4,800,841 1/1989 Yananton et al. ..... 119/1
4,869,204 9/1989 Yananton ..... 119/1
4,934,316 6/1990 Mack ..... 119/1

*Primary Examiner*—Joseph Man-Fu Moy
*Attorney, Agent, or Firm*—Francis T. Kremblas, Jr.

[57] ABSTRACT

An improved diaper container to temporarily store soiled diapers prior to final disposal thereof which is characterized by an outer fluid impervious shell provided with a removably mounted liner. The liner comprises a pad of non-woven synthetic fibers impregnated with an odor adsorbing material, such as activated carbon. The outer shell is provided with a hinged lid for access to the interior of the container and the liner is slideably mounted within the outer shell in a snug fit with the inner walls of the outer shell. The activated carbon entraps noxous odors within the liner to effectively prevent the odors from escaping from the container when it is opened.

9 Claims, 3 Drawing Sheets

TEMPORARY DIAPER STORAGE CONTAINER

This is a continuation-in-part of my co-pending application Ser. No. 07/529,506, filed May 29, 1990, now U.S. Pat. No. 5,022,553.

TECHNICAL FIELD

The present invention relates generally to containers for temporarily storing soiled diapers prior to final disposal or laundering, as the case may be, and particularly to an improved container provided with a replaceable inner liner which adsorbs the noxious odors typically associated with soiled diapers.

BACKGROUND ART

Whether one uses a disposable type diaper or a washable and re-usable diaper, satisfactory and convenient temporary storage of soiled diapers prior to final disposal or laundering represents a long-felt problem.

The noxious odors emanating from soiled diapers is highly undesirable. However, it is not convenient to immediately transport each soiled diaper to an outdoor storage vessel. One hesitates to leave the infant unattended or to carry both the infant and the soiled diaper to a remote location from the area normally used to change the diaper.

A resealable plastic garbage bag or even a conventional plastic diaper pail having a tight lid only contains the odors when sealed. Upon opening the same, the noxious odors escape into the area giving an extremely unpleasant sensation to the person attempting to place another soiled diaper into the container. Diaper pails provided with a pleasant masking scent become all too quickly ineffective to mask such odors and have generally failed to solve the problem.

Locating such containers in a remote location or outdoors is inconvenient and generally unsatisfactory. Further this does not solve the problem of encountering the extremely strong odors when the container is opened to deposit another soiled diaper.

The scented diaper pail, which has been commercially available for many years, is most often placed in the nursery or other selected area where the diaper is most often changed. However, such containers tend to retain the noxious odors even after the diapers have been removed. Therefore, a thorough and complete cleaning of such a container is necessary on a regular schedule to reduce the lingering odor. However, the odor problem continues when such containers are used again to store soiled diapers.

Prior to the present invention, a storage container for soiled diapers which satisfactorily solves the odor problem in a practical and economically affordable manner has not been proposed or suggested by those skilled in this field.

BRIEF DISCLOSURE OF INVENTION

The present invention relates to the temporary storage of soiled diapers within the home residence or the like and particularly to an improved storage container, commonly referred to as a diaper pail, which effectively eliminates most, if not all, noxious odors emanating from the soiled diapers.

In accordance with a preferred embodiment of the present invention, the novel diaper pail includes a permanent outer shell having a lid closure and a removable, replaceable liner slideably fit within the outer shell.

The liner comprises a pad of non-woven fibers impregnated with odor adsorbing particles, such as activated carbon, which effectively adsorb the gaseous odors typically produced from soiled diapers. It has a configuration mated with the inner surface of the side walls of the outer shell to slideably fit within the shell in a light interference fit so the contents may be emptied easily without disturbing the position of the liner.

However, the liner may also be slideably removed and a new liner replaced when its odor adsorbing capacity has been reached.

The liner pad is semi-rigid and has a generally self-supporting nature in order to be more easily inserted or removed from the outer shell of the container.

In another preferred embodiment of the present invention, the inner surface of the outer shell is provided with a lip portion disposed circumferentially below the top opening of the outer shell. The adsorbing liner has a height dimension reduced to fit under the lip portion and extend to a bottom wall of the outer shell. The lip functions as a positive retaining means to hold the liner in position when one empties the container of any soiled diapers.

In a more preferred embodiment, the adsorbing liner is removably mounted over the inner or bottom surface of a top closure member which itself is mounted to the outer shell between open and closable positions to access the interior of the outer shell.

In a particularly preferred embodiment of the present invention the closure means include a first and second cover portion, each mounted between open and closed positions relative to a top opening of the outer shell. Each of these cover portions may be fit with removably mounted liner pads to provide additional adsorbent capacity to this configuration. Additionally, this configuration can be constructed to offer very convenient manipulation of the cover portions by the user and the liner pads are not directly exposed to or contacted by any liquid or semi-liquid wastes in the diapers.

Also disclosed are several closure means constructions having alternative means for removable mounting of one or two liner pads in an efficient operative position to adsorb offensive odors emanating from soiled diapers placed inside the outer shell.

It is therefore an object of the present invention to provide an improved temporary storage container for soiled diapers which effectively eliminates the noxious odors produced by the soiled diapers.

It is another object of the present invention to provide a storage container of the type described which can be conveniently stored within the residence without the fear of contaminating the area with the noxious odors typically associated with soiled diapers.

It is still another object of the present invention to provide a storage container of the type described which economically incorporates a removable odor adsorbing liner with a permanent outer container shell wherein the liner adsorbs the noxious odors and prevents their escape when the outer shell is opened.

It is yet another aspect of one preferred embodiment of the present invention to provide a soiled diaper container in which the liner pads are removably mounted on the lower or inner surface of a top closure means away from direct contact with the soiled diapers.

It is a further object of the embodiment referred to above to provide the removable liner pads in a dual closure means while still providing easy, convenient manipulation thereof by the user.

Figure 1:
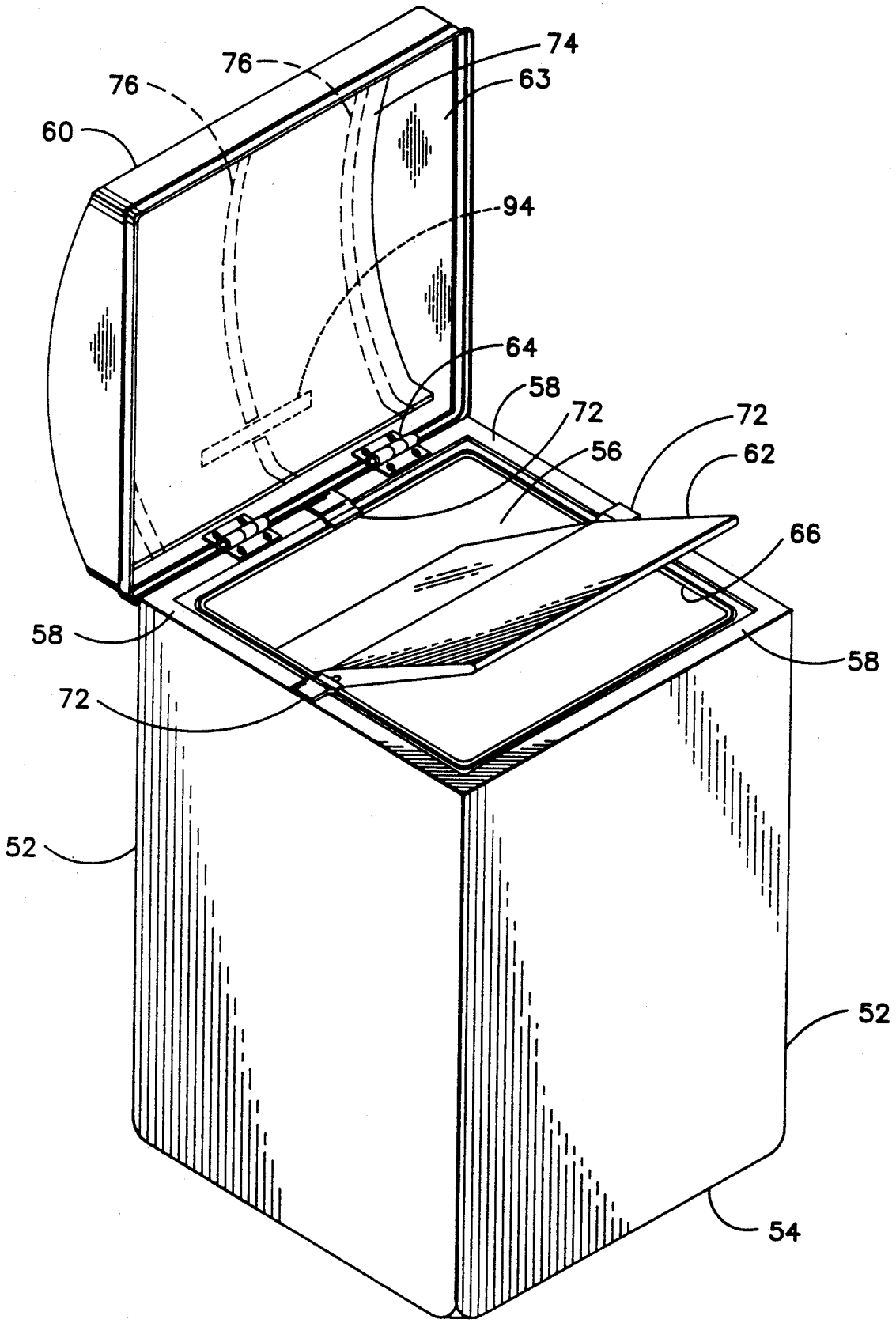
FIG. 1 is a perspective view of another preferred embodiment constructed in accordance with the present invention wherein the adsorbent liner pad is removably mounted to the undersurface of a top closure means.
Figure 2:
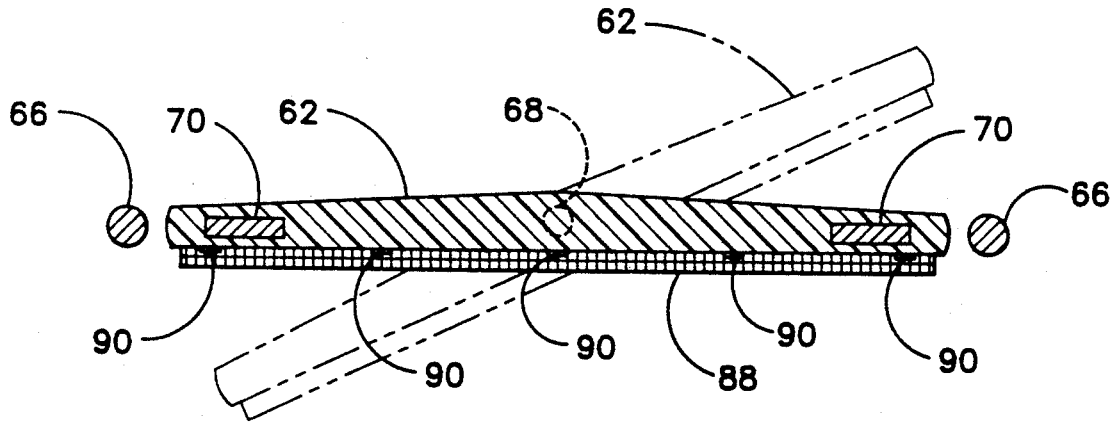
FIG. 2 is a side sectional view of one of the cover means forming a closure used in the embodiment shown in FIG. 1, the cover means shown removed from the outer shell or container.
Figure 3:
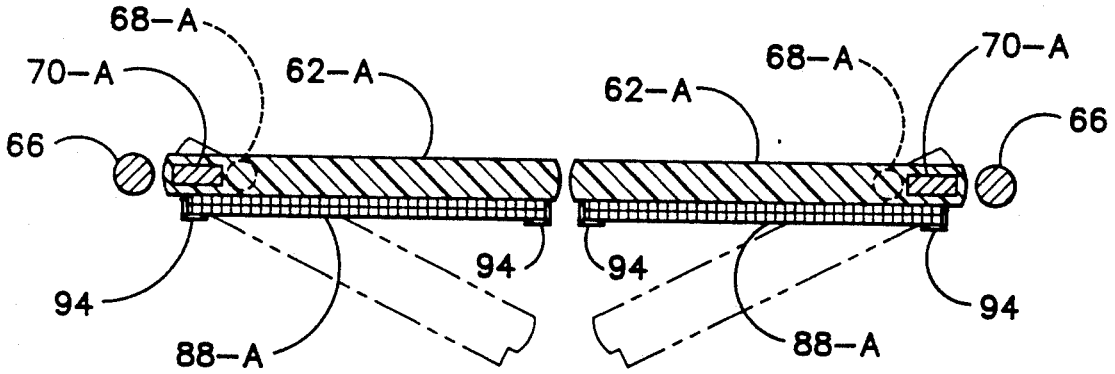
Figure 4:
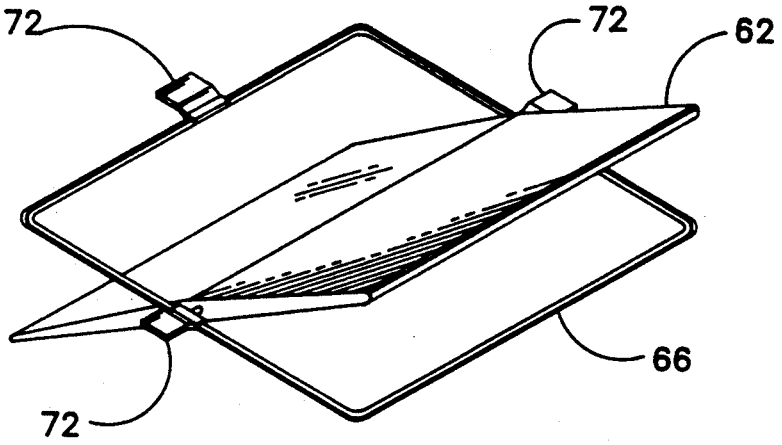
Figure 5:
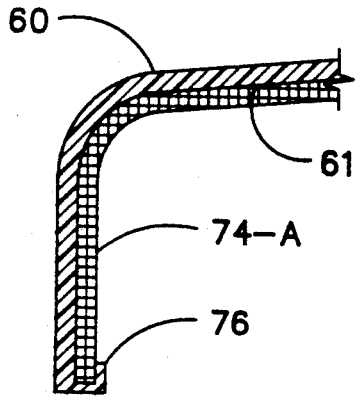
Figure 6:
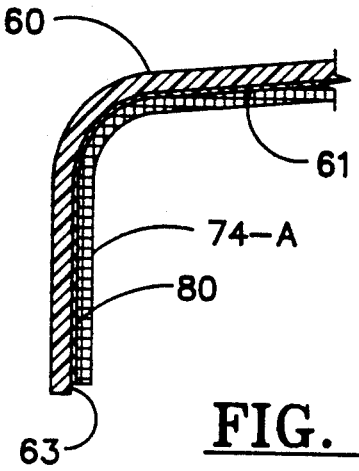
Figure 7:
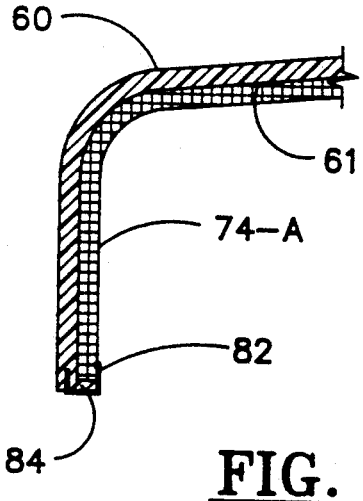
Figure 8:
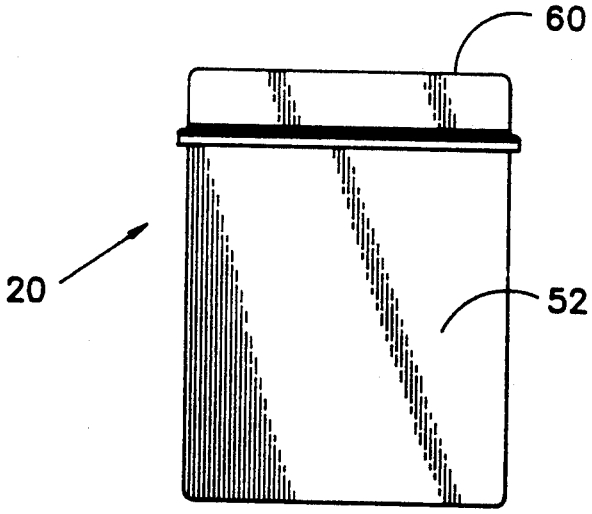
Figure 9:
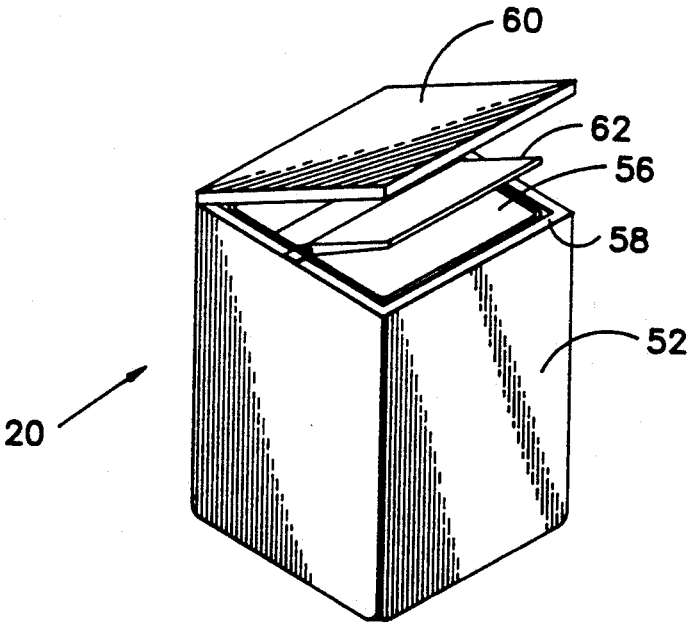

FIG. 2-A is a side sectional view of an embodiment of a cover means which may be used as an alternative for the cover means shown in FIG. 2;

FIG. 3 is a perspective view of the cover means shown in FIG. 2 illustrating the surrounding supporting frame which is freely removably mounted over the top opening of the outer shell;

FIG. 4–6 are partial side elevational views of the primary cover means which may be utilized with the embodiment shown in FIG. 1, illustrating alternative means to removably mount an adsorbent liner pad to the bottom or underside of the cover means;

FIG. 7 is a front elevational view of the diaper container shown in FIG. 1 with the top cover means disposed in a closed position; and FIG. 8 is a perspective view of a modified embodiment of the diaper container shown in FIG. 1, illustrating a lower profile top cover means constructed in accordance with the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

A temporary diaper storage container or diaper pail constructed in accordance with the present invention and includes an outer container or shell. Outer shell includes side walls, a bottom wall, a top opening, indicated generally at, and a hinged lid providing selective access to the interior of shell.

In one of the embodiments outer shell is fabricated from corrugated paper provided with a wax coating or other moisture-proof barrier. It is conventionally manufactured from a single cut blank which provides a folded double thickness for extra support in bottom wall and includes a plurality of folds forming vertical reinforcing ribs between the plural side wall sections forming an octagonal shape. This shape is best seen in the configuration of bottom wall.

This particular material and configuration is chosen primarily for its relatively inexpensive cost, yet it possesses sufficient strength to support a very satisfactory number of diapers for the intended use. A convenient capacity for the user relative to the weight of a container full of soiled diapers is estimated to be at least about 30 to 45 medium-sized diapers. Such capacity would require removal of the diapers from the storage container no more than typically once a week on the average. The diapers removed would normally be transferred to a plastic garbage bag or the like and appropriately sealed for ultimate disposal with the other trash and garbage.

However, the outer shell container may have a different specific configuration and be made of other moisture proof materials appropriate to perform the intended function without departing from the present invention. Such materials include a plastic suitable for the intended purpose.

The storage container is provided with a removably mounted liner capable of adsorbing an effective amount of the noxious odors emanating from soiled diapers to eliminate or dramatically reduce the offensive sensation of such odors to the user.

In the preferred embodiment, liner comprises a mat or pad formed from non-woven synthetic fibers. The liner pad is impregnated with an amount of activated carbon particles using well-known conventional techniques to provide effective adsorption of the noxious gaseous products emanating from soiled diapers and the like. The effective odor adsorbing life span of the liner pad depends upon the amount of activated carbon contained within the pad up to the practical limits of the impregnation process.

The liner pad is also impregnated with binders and stiffening agents to impart a reasonable degree of rigidity to render the pad generally self-supporting within the limited practical size useful in a diaper pail constructed in accordance with the present invention. Liner pad is initially manufactured in flat sheets. The sheets are cut and scored to a selected size and then formed into a hollow, tubular configuration to fit within outer shell.

The degree of stiffness or rigidity referred to above is sufficient to enable one to slideably insert liner pad, fully within the outer shell with a light interfering or snug fit in contact with the inner surfaces of walls without significant deforming of the pad or causing it to collapse. Of course, the snug fit is not so great as to prevent slideably inserting or removing a pad with relative ease as necessary.

Further, the light interference fit permits the soiled diapers to be removed by merely turning the container upside down to empty the contents into a trash bag or the like for permanent disposal, without inadvertently disturbing the position of the liner.

Liner is preferably manufactured in sheet form of the desired thickness. After drying, the sheets are scored and cut to size. They are formed into a cylinder like or tubular configuration by joining opposing ends and fixing an opposing pair of ends together by heat sealing or an adhesive. In the preferred embodiment, a plurality of vertically extending pleats, are formed by a conventional heat sealing process and spaced to conform to the ribs of the outer shell. This permits liner to better conform to the configuration of the inner walls of outer shell for the light interfering fit desired.

If the inner wall surface of shell has a round or other configuration, liner would be made to conform accordingly to relatively snugly engage the side walls.

In using the diaper storage container of the present invention, the user may locate the outer shell containing the liner pad in the most desirable location conveniently in or near the area used most often for changing diapers.

Closure lid is provided with a downturned lip portion which extends over a portion of outer shell to completely close opening. Lip also provides means for easily manipulating lid to an open position.

Once the soiled diaper is placed within the container and the lid is closed, the noxious odors are substantially confined within the container. Over a relatively short period of time, the odors generated are adsorbed by the activated charcoal in liner 32 and entrapped therein. Upon opening lid, tests indicate no unpleasant odor can be observed by the user.

Tests results have shown that even after several soiled diapers have been placed into container, over an extended period of time, no noticeable odor is present upon opening lid. Further no unpleasant or noxious odor is noticeably present in the immediate area of a container loaded with several soiled diapers. The gaseous products responsible for the unpleasant odors appear to be very effectively adsorbed and contained within the activated carbon in the liner.

These results contrast sharply with comparable results using conventional scented or unscented diaper pails or the like. Typically, after storage of merely a few soiled diapers, a very strong, repugnant odor is present upon opening the lid of the conventional diaper pail. Such odors overcome the masking scent present in the scented pails. The unpleasant odor which escapes upon opening the pail is also noticeable for several minutes in the surrounding area, particularly if it is relatively small, such as a typical nursery. Further, once a conventional diaper pail has been used, even after unloading the contents and cleaning the container, the empty used pail retains a lingering noxious odor.

Liner pad is preferably impregnated with activated carbon using conventional well-known processes. A quarter-inch thick pad, loaded with about a two hundred weight percent of activated carbon based upon the unimpregnated weight of the pad, has effectively adsorbed odors for between three to four months. This effective life is based upon a typical average usage of diapers for one infant during the same period. Near the end of that period, the user will begin to notice a slight degree of lessening of the liner pad's effectiveness. When odors begin to become slightly noticeable, this signals that a new pad should be installed.

The old pad is then simply removed and discarded, and a new pad replaced to return the storage container to its original odor adsorbing efficiency.

While activated carbon appears to be the most economically efficient material for impregnation of pad, other materials, such as zeolite, which are effective to adsorb the odors of soiled diapers may be used alone or in combination with activated carbon without departing from the spirit of the present invention.

Another embodiment is identical except for the addition of a retaining lip 40 the inner surface of outer shell and a latch mechanism provided for lid.

The retaining lip consists of another layer of the identical material used to construct outer shell which extends downwardly from the top edge of shell only a short distance sufficient to form an inwardly extending protrusion. Lip may be formed continuously around the interior of shell or it may consist of a plurality of spaced ledges or lips individually connected to the inner surface of walls in the same vertical plane.

Liner is modified in its vertical dimension to extend from the underside of lip to the bottom wall of outer shell. Lip functions to provide means for more positive retention of liner when fully inserted, particularly when one inverts container in order to dump its contents.

Preferably lip is at least no wider than the cross-sectional dimension of liner so as not to unreasonably inhibit the initial insertion or the intentional removal of liner from outer shell.

When employing the embodiment including retaining lip, the degree of the interfering fit between the liner and the inner surface of side walls may be slightly relaxed as lip functions as a positive retaining means to prevent inadvertent removal of the liner.

Insertion of liner may be accomplished in a similar manner with relatively easy maneuvering of liner in a folded relationship along one or more of the pleats or fold lines through top opening and past lip. Once liner is partially inserted past lip, the user merely pushes downwardly and outwardly on the inner surface of the liner with the pleats aligned with riles. In this manner liner may be slideably inserted fully into container in engagement with the inner surfaces of side walls.

To remove a used liner, the user must first pull or otherwise work the upper edge of liner free of lip and then simply pull the remainder of the liner outwardly through top opening.

A latch mechanism is provided to more securely close lid in a closed position. A resilient male latch member is fixed to the inner lower edge of lid and is conformed to mate with a female member fixed within one of the side walls of outer shell. Pulling outwardly on male latch member 44 releases a right-angled corner portion from engagement with the indented female member to permit unrestricted opening of lid. Appropriate alignment permits the male latch member to automatically re-engage itself with female member upon closing lid. It should be noted that other conventional forms of a light latching mechanism could also be employed to achieve a similar positive closure of lid.

With reference to the modified embodiments of the diaper container shown in FIGS. 1–8, the primary difference from the embodiment earlier described relates to the modified closure means and locating the removably mounted liner on the bottom of undersurface of at least one, or preferably, two cover portions.

As seen in FIG. 1, an outer container or shell, indicated generally at 50, includes side walls 52, a bottom wall 54, and a top opening 56 defined by the upper edges 58 of side walls 52.

A closure means, preferably comprising a first or primary cover 60 and a second or alternative cover 62 are provided to close or cover top opening 56.

Primary cover 60 preferably is pivotally or hingedly connected to side walls 52 by conventional hinges, such as 64, between an open position, such as shown in FIG. 1, and a closed position such as shown in FIG. 8. For the primary purpose of the present invention, cover 60 need not be pivotally connected, however, it is deemed more convenient to the user to do so.

Secondary cover portion 62 is pivotally supported by a wire frame 66 about a pin 68 fixed across frame 66 and extended through cover 62 in a normally horizontal position to form a swinging door-like closure. Cover 62 is biased to return to the horizontal position by means of counterweights 70 inserted within appropriate recesses provided in cover 62 and fixed therein by adhesives or other suitable means.

An alternative construction for cover 62 is shown in FIGS. 2-A. This modified embodiment comprises a pair of identical horizontal door members 62-A. Each member 62-A is pivotally mounted to an essentially identical wire frame 66 via a pair of pins 68-A such that each door member 62-A can be pivoted downwardly to permit a diaper to be placed into shell 50. Each door member 62-A is provided with counterweights 70-A in a similar manner as previously described for the embodiment shown in FIG. 2 to bias their return to a horizontal position.

Frame 66 is conveniently removably mounted over top opening 56 via flange members 72 adapted to engage and rest upon the upper edges 58 of side walls 52. This permits frame 66 and covers 62 or 62-A to be easily removed to permit the user to empty the contents of shell 50 or to replace the adsorbent liner pads mounted under the covers as described later in detail herein. Flanges 72 may be fixed to frame 66 in any convenient conventional manner which assures sufficient support for frame 66 and cover 62 or 62-A.

In the more preferred embodiments of the present invention, an adsorbent liner pad comprising the same or equivalent material as described earlier herein in is removably mounted to the bottom or undersurface of primary cover 60 and secondary cover 62 or 62-A.

As seen in FIG. 2, a liner pad 74 of non-woven synthetic fibers impregnated with an adsorbent material, preferably activated carbon, is removably mounted to the bottom surface of primary cover 60 in any convenient manner. Alternative means to removably mount a liner pad to cover 60 are shown in FIGS. 4–6.

The preferred non-woven synthetic pad 74 may be conveniently removably held in position by using strips 76 such as those used in VELCRO gripping means. Strips 76 may be adhesively bonded to the undersurface of cover 60 and comprise the male portion of the conventional VELCRO gripping means which is readily accepted by the non-woven synthetic fiber material forming liner pad 74 in a removably grasped relationship similar to the female portion of the well-known VELCRO gripping means.

Preferably the non-woven synthetic fiber pad material impregnated with activated carbon, or other suitable adsorbent material, is essentially identical to those types of readily commercially available gaseous filter pads such as sold by Columbus Industries, Inc. and others. It is made by well-known processes as earlier described. The loading of the pad with the adsorbent material may be varied within the conventional attainable ranges of impregnation known to those skilled in the art to obtain the desired level of adsorbent capacity selected relative to providing a reasonable, practical life span for the intended use.

A loading of activated carbon of at least about two hundred weight percent of activated carbon based upon the unimpregnated weight of the pad will work effectively in the embodiment described in FIGS. 1–8. However, other effective loading amounts of adsorbent may be chosen based upon the practical requirements of the marketplace without departing from the spirit of the present invention.

However, other suitable materials which are capable of being impregnated with a sufficient amount of a suitable adsorbent material could be employed as the odor adsorbing liner pad 74 without departing from the spirit of the present invention. Merely as examples, reticulated polyester or polyether foams would be expected to be operable within the context of the present invention.

With reference to FIGS. 4–6, a variety of alternative means to replaceably mount a liner pad to the undersurface of cover 60 are shown. Also illustrated is a modified liner 74-A having a configuration which also extends over the downwardly extending portions 63 of the undersurface 61 of cover 60 if additional adsorbent capacity is desired. In each example shown in FIGS. 4–6, liner pad 74-A may be configured to closely conform to the given configuration of the undersurface of cover 60. Fold lines, not shown, such as described in relation to the embodiment earlier described herein may be formed in liner pad 74-A if deemed desirable for fitting purposes.

As seen in FIG. 4, an upwardly facing recess is formed by a lip 78 provided around the inside of the lower edge of cover 60 and adapted to receive the surrounding edges of pad 74-A. The pad 74-A is formed with a degree of stiffness sufficient to maintain its intended configuration in close lying relationship with the undersurfaces 61 and 63 of cover 60.

As seen in FIG. 5, liner pad 74-A is removably mounted to the undersurfaces 61 and 63 of cover 60 by the male strip portion 80 of a conventional VELCRO gripping means in the same manner as previously described.

As seen in FIG. 6, a metal clip 82 is fixed to the lower edge of cover 60, and in cooperation with a lip 84 formed on the inner surface of cover 60, form a recess adapted to receive the edge of liner pad 74-A in a similar manner to the embodiment shown in FIG. 4.

Other forms of conventional mounting means could also be employed to removably mount liner pad 74 or 74-A adjacent to the undersurface of cover 60 in a suitable manner without departing from the spirit of the present invention.

Now referring to FIGS. 2 and 2-A, an additional liner pad 88 or 88-A is removably mounted to the bottom surface of secondary cover 62 or 62-A in most preferred construction of the embodiment shown in FIGS. 1–8. This additional liner pad provides extra adsorbent capacity when combined with the liner pad 74 or 74-A on cover 60 such that a very useful life span for these removably mounted pads is efficiently provided in a manner providing economical convenience for the user and highly efficient odor removal.

However, depending upon a selected cycle for replacing liner pad 74, one could employ a single cover 60 and liner pad 74 without departing from the spirit of the invention. Using only one odor filter or adsorbent liner pad may require a thicker pad and heavier loading of the impregnated adsorbent material to obtain commercially useful odor removal efficiency and/or a useful life span of the liner pad acceptable to the user. In view of the relative ease of mounting and replacing the liner pads, having both secondary cover 62 and cover 60, each with their respective liners, is believed to be the most practical and efficient arrangement.

Liner pads 88 and 88-A are made of the same material as line pad 74 and may be removably mounted to the underside of covers 62 or 62-A in any convenient conventional manner. One preferred means is shown in FIG. 2 wherein a plurality of male VELCRO strips 90 are adhesively fixed to the underside of cover 62 to releasably grip liner pad 88 in the same manner as previously described herein.

As seen in FIG. 2-A, a recess surrounding the periphery of the underside or bottom surface 92 of cover 62-A is formed by an L-shaped flange or lip 94 conformed to receive the outer edges of liner pad 88-A closely adjacent to the bottom surfaces of door members 62-A.

One of the advantages of the embodiment shown in FIGS. 1–8 is that the liner pads 74 and 88 are easily accessible to the user and easily removed and replaced with new liner pads when exhausted.

A further advantage of this latter embodiment is that the liner pads 79 and 88 or 88-A are not directly in contact with the soiled diapers so that no liquid wastes in the diapers are likely to be adsorbed into the pads. These significantly lessen any tendency for mold to form in the pads to either interfere with their adsorptive capacity or be a source of offensive odor.

As mentioned earlier herein, frame 66 carrying secondary covers 62 or 62-A is easily removed by lifting frame 66 from the upper edges 58 of sides 52. This feature provides for easily removing the soiled diapers stored within shell 50 for transfer to a plastic trash bag. Further, many users prefer to place a conventional empty plastic trash bag in the shell 20 and may easily do so by draping the upper edges of the trash bag over the upper edges 58 of side walls 52 and placing the frame 66 in position to hold the trash bag in position.

Alternatively, well-known means may be used to permit the trash bag to be releasably fixed in a similar position, such as providing a form of hook, clamp or other releasable securing means around the upper edges 58 or on the interior surface of side walls 52 near the top opening to hold the trash bag in a secure position.

Using a trash bag in this latter described manner alleviates any need to transfer the soiled diapers from the shell to another trash bag for removal. The user merely removes frame 66 and lifts the bag containing the diapers from the shell 20 for easy removal.

Therefore it should be readily understood that the modified embodiment shown in FIGS. 1-8 provide further advantages as compared to the embodiments earlier described herein relating to user convenience and economy while maintaining effective reduction of any offensive odors generated by the stored soiled diapers.

It should also be pointed out that it is preferred, but not necessary, that cover 60 include a lower surrounding lip, such as at 65, which extends in relatively close-fitting relationship to the upper edges 58 of side walls 52 and extends slightly lower than edges 58. This provides a better seal to prevent the escape of odors prior to being adsorbed by one of the liner pads on cover 60 and 62.

Further, it has been found to be very advantageous to provide a small opening in cover 60, such as slot 94, which is covered by liner 74. Such an opening, protected by liner 74, has been found to reduce the rush of offensive gaseous materials from the soiled diapers stored in shell 20 caused by the draft pulled by rapid opening of cover 20. The slot 94 provides access to air outside shell 20 to pass through the filter formed by liner 74 to significantly reduce the tendency to pull the noxious gases within shell 20 outwardly through top opening 56 upon opening cover 60.

It should also be pointed out that cover 60 can be easily modified to be opened and closed by a foot operated lever connected to cover 60 in the well-known and conventional manner employed with presently available plastic diaper containers or waste containers without departing from the spirit of the present invention.

Lastly, the embodiment shown in FIG. 8 represents a modified configuration for cover 62 forming a lower profile flat appearance. However, in all other respects it may be constructed in a similar manner regarding liner 74 and secondary cover 62.

While certain preferred embodiments of the present invention have been disclosed in detail, it is to be understood that various modifications may be adopted without departing from the spirit of the invention or scope of the following claims.

I claim:

1. A container for temporary storage of soiled diapers comprising, in combination;

a) a shell having side walls, a bottom wall and a top opening spaced from said bottom wall providing access to an interior area of said outer shell;

b) closure means having a top and bottom surface and configured to cover said top opening, said closure means being movable between an open position and closed position relative to said top opening; and c) a liner removably mounted over the bottom surface of said closure means, said liner being impregnated with an amount of odor-adsorbing material effective to adsorb a substantial amount of noxious gaseous materials commonly associated with soiled diapers.

2. The container defined in claim 1 wherein said liner is a pad of non-woven synthetic fibers.

3. The container defined in claim 1 wherein said odor adsorbing material is activated carbon.

4. The container defined in claim 1 wherein said closure means is provided with an opening permitting the passage of air through said liner.

5. The container defined in claim 1 wherein said side walls include an upper edge defining said top opening and said closure means includes a first cover portion movable between an open and closed position relative to said top opening and a second cover portion removably mounted to said side walls below said first cover portion and extending across said top opening, said second cover portion being movable between an open and closed position relative to providing access to said interior area of said shell through said top opening, at least one of said first and second cover portion having a bottom surface provided with a removably mounted liner impregnated with an amount of an odor adsorbing material effective to adsorb a substantial amount od noxious gaseous materials commonly associated with soiled diapers.

6. The container defined in claim 5 wherein said first cover portion is hingedly mounted to said side walls for pivotal movement between open and close positions.

7. The container defined in claim 5 wherein said second cover portion includes a surrounding supporting frame removably mounted to said side walls of said shell and a movable door portion, said movable door portion being pivotally connected to said frame between a closed and an open position relative to accessing said interior area of said shell.

8. The container defined in claim 1 wherein said closure means includes means for releasably engaging said liner in a position adjacent to said bottom surface of said closure means.

9. The container defined in claim 5 wherein the bottom surface of both said first and second cover portions are provided with a removable liner impregnated with an amount of odor adsorbing material effective to adsorb a substantial amount of noxious gaseous commonly associated with soiled diapers.

* * * * *